US006281480B1

(12) United States Patent
Haberstetter

(10) Patent No.: US 6,281,480 B1
(45) Date of Patent: Aug. 28, 2001

(54) INSTALLATION STRIP FOR A COOKTOP

(75) Inventor: Nikolaus Haberstetter, Waging (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/531,343

(22) Filed: Mar. 20, 2000

(30) Foreign Application Priority Data

Mar. 19, 1999 (DE) ..... 199 12 452

(51) Int. Cl.[7] ..... H05B 3/68
(52) U.S. Cl. ..... 219/412.12
(58) Field of Search ..... 219/451.1, 452.11, 219/452.12; 126/211, 217, 218

(56) References Cited

U.S. PATENT DOCUMENTS 4,453,533 * 6/1984 Scheidler et al. ..... 219/452.12
4,492,217 * 1/1985 Scheidler ..... 219/452.12
5,317,129 * 5/1994 Taplan et al. ..... 219/452.12
5,429,114 * 7/1995 Taplan et al. ..... 219/452.12
5,571,434 * 11/1996 Cavener et al. ..... 219/452.12
5,584,957 * 12/1996 Schultheis et al. ..... 219/452.12

FOREIGN PATENT DOCUMENTS 30 09 961 C2 10/1982 (DE) .

* cited by examiner

*Primary Examiner*—Sang Paik
(74) *Attorney, Agent, or Firm*—Herbert L. Lerner; Laurence A. Greenberg; Werner H. Stemer

(57) ABSTRACT

An installation strip for the surface-flush installation of a panel of a cooktop in a work-top includes a supporting section for supporting the cooktop. In order to ensure the surface-flush installation in the simplest possible manner, the installation strip has at least one suspension section suitably spaced apart, in a vertical direction, from the supporting section for suspendedly positioning the supporting section of the installation strip relative to a top side of a work-top in a border region of a work-top cutout. The suspension section is connected to the supporting section at a given point, which can be a bending or predetermined breaking point.

8 Claims, 1 Drawing Sheet

INSTALLATION STRIP FOR A COOKTOP

BACKGROUND OF THE INVENTION

Field of the Invention

The invention lies in the field of household appliances. The present invention relates to an installation strip for a cooktop, or hob, for the surface-flush installation of a cooktop panel in a work-top or counter cutout, and to a correspondingly equipped cooktop. The installation strip has a supporting section for supporting and securing the cooktop or the cooktop panel.

An installation frame is disclosed by German Patent DE 30 09 961 C2. The installation frame is first fastened in the work-top cutout by screws with a height tolerance of +/−0.5 mm. An elastic sealing material is fastened around the top horizontally extending leg of the installation frame. For installation, the cooktop is positioned loosely on the sealing material applied to the installation frame. Following completion of the surface-flush installation of the cooktop unit in the work-top, the remaining peripheral gap is jointed with a silicone adhesive.

SUMMARY OF THE INVENTION

It is accordingly an object of the invention to provide an installation strip for a cooktop that overcomes the hereinafore-mentioned disadvantages of the heretofore-known devices of this general type and that simplifies the surface-flush installation of a cooktop in a work-top cutout.

With the foregoing and other objects in view, there is provided, in accordance with the invention, in a work-top having a top side and a cutout with a border region, an installation strip for the surface-flush installation of a panel of a cooktop including a supporting section for supporting the cooktop, and at least one suspension section for suspendedly positioning the supporting section relative to a top side of a work-top in a border region of a work-top cutout, the at least one suspension section being spaced apart from the supporting section and connected to the supporting section.

In accordance with another feature of the invention, the at least one suspension section is vertically spaced apart from the supporting section.

The installation strip has at least one suspension section that is suitably spaced apart from the supporting section in the vertical direction. The suspension section is intended for positioning the installation strip relative to the top side of the work-top by suspending the installation strip in the border region of the cutout. The suspension section is connected to the installation strip by a bending or predetermined breaking point. Thus, the invention dispenses with the high-outlay operation of positioning the installation strip heightwise relative to the top side of the work-top in the work-top cutout. The vertical distance between the supporting section and the suspension section of the installation strip is realized, taking into account the overall height of the cooktop, and, if appropriate, of additional seals, such that the surface-flush installation of the cooktop panel is always ensured.

In accordance with a further feature of the invention, the supporting section supports a cooktop panel of the cooktop.

In accordance with an added feature of the invention, the suspension section is connected to the supporting section at a bending point.

In accordance with an additional feature of the invention, the suspension section is removably connected to the supporting section at a predetermined breaking point.

In accordance with yet another feature of the invention, the work-top cutout has a longitudinal side and the supporting section and the at least one suspension section together extend essentially over the entire length of the longitudinal side.

To ensure that the cooktop is secured in the work-top cutout as reliably as possible, the installation strip extends essentially over the entire length of a longitudinal side of the work-top cutout.

In accordance with yet a further feature of the invention, the work-top cutout has an inner side, and the supporting section is plate-shaped and extends horizontally from the inner side of the work-top cutout to beneath a cooktop panel. The configuration ensures that, when the peripheral gap between the work-top cutout and the end surface of the cooktop panel is jointed, the silicone adhesive cannot pass into the installation space beneath the cooktop.

Installation strips can be connected to one another and, thus, form an installation frame. In accordance with yet an added feature of the invention, the supporting section is a plurality of supporting sections, and the plurality of supporting sections form an installation frame.

With the objects of the invention in view, there is also provided a cooktop for installation in a work-top having a top side and a cutout with a border region including a cooktop panel, and at least one installation strip for the surface-flush installation of the cooktop panel in a work-top, the at least one installation strip having a supporting section for supporting a cooktop, and at least one suspension section for suspendedly positioning the at least one installation strip relative to a top side of the work-top in a border region of a work-top cutout, the at least one suspension section being spaced apart from the supporting section and connected to the supporting section.

Other features that are considered as characteristic for the invention are set forth in the appended claims.

Although the invention is illustrated and described herein as embodied in an installation strip for a cooktop, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DESCRIPTION OF THE PREFERRED EMBODIMENTS

Figure 1:
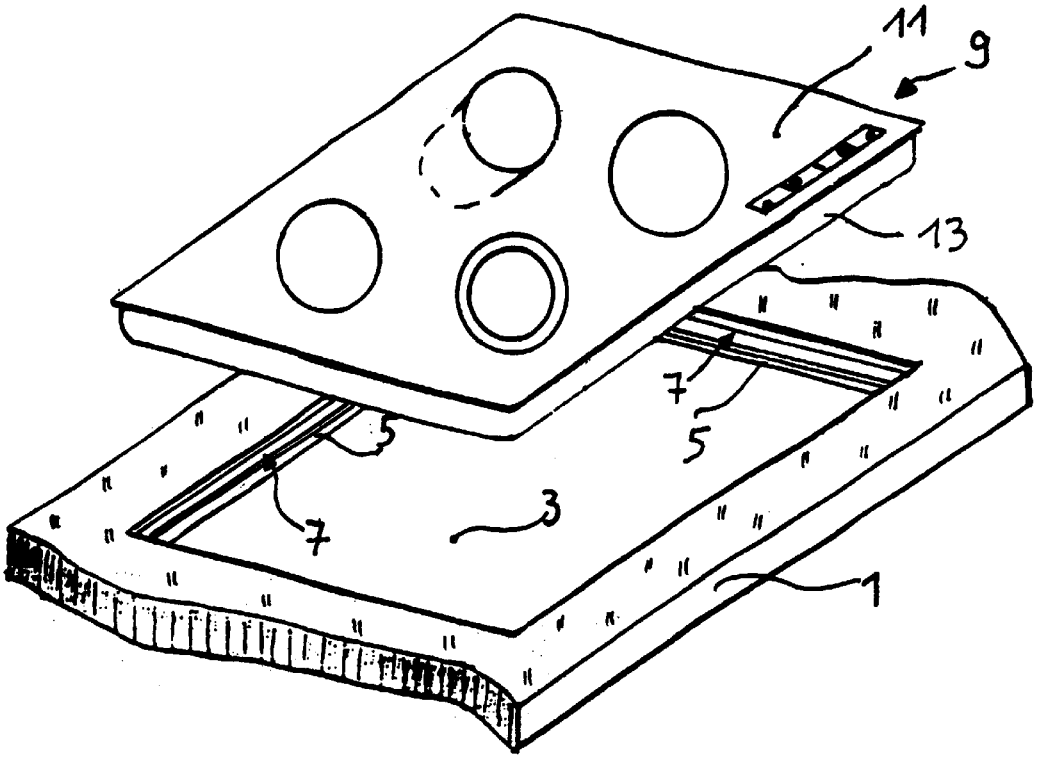
FIG. 1 is a diagrammatic, fragmentary, perspective plan view of a work-top cutout with installation strips fitted in the cutout according to the invention with a perspective plan view of a cooktop to be installed within the cutout.

In all the figures of the drawing, sub-features and integral parts that correspond to one another bear the same reference symbol in each case.

Figure 3:
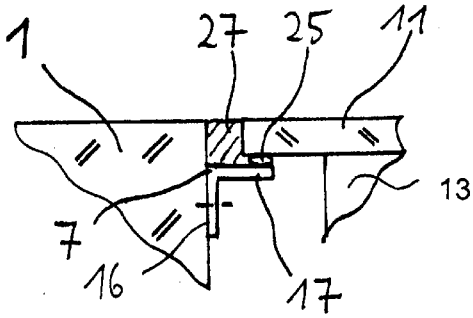
FIG. 3 is a diagrammatic, fragmentary cross-sectional view of the cooktop installed in the work-top cutout of FIG. 1.

Referring now to the figures of the drawings in detail and first, particularly to FIG. 1 thereof, there is shown a work-top 1 with a right-angled cooktop cutout 3. Non-illustrated screws fasten sheet-metal angles 7 on each of the four inner sides 5 of the cooktop cutout 3. Alternatively, it is also possible for the sheet-metal angle 7 to be produced from a suitable plastic. A cooktop 9 with four marked cooking points (or burners) has a cooktop panel 11 made of glass ceramic. The cooktop panel 11 is to be installed flush with the surface of the work-top 1 (FIG. 3 illustrates the installed state of the cooktop 9). Secured beneath the cooktop panel 11 is a cooktop tray 13, in which there are conventionally disposed non-illustrated heating elements and further components of the cooktop 9.

Figure 2:
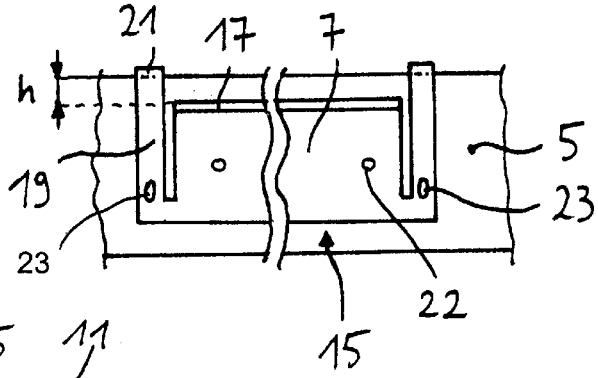
FIG. 2 is a diagrammatic, fragmentary sectional view of an inner surface of the work-top cutout showing the installation strip of FIG. 1 before the installation of the cooktop.

In order to fit the sheet-metal angle 7 in the correct position within the cooktop cutout 3, an installation strip 15 includes a sheet-metal angle 7 having a fitting leg 16 and a supporting leg 17, and a fitting angle 19 connected to the sheet-metal angle 7 (FIG. 2).

For purposes of fitting, the installation strip 15 is positioned on a top side of the work-top 1 using suspension legs 21 that are formed on the top end section of the fitting angle 19, and is thus suspended in the border region of the work-top cutout 3 (FIG. 2). The installation strip 15 is then screwed firmly to the inner side of the work-top cutout 3 through fitting openings 22. The fastening secures the position of the installation strip 15 within the cooktop cutout 3 (FIGS. 2 and 3). In particular, the vertical distance from the top side of the work-top 1 to the top side of the supporting leg 17 is fixed precisely. The distance h (FIG. 2) is identical to the distance between the underside of the suspension leg 21 and the top side of the supporting leg 17. The height h is coordinated with the thickness of the cooktop panel 11 that is to be installed and, if appropriate, with necessary intermediate elements. Before the installation of the cooktop 9 within the work-top cutout 3, preferably, the two fitting angles 19 of the firmly screwed installation strip 15 are severed from the installation strip 15 in a region of a predetermined breaking point 23, leaving behind the sheet-metal angle 7 fitted in the correct position within the cooktop cutout 3. A rubber seal 25 is applied around the periphery of the top side of the supporting leg 17, and the cooktop panel 11 is positioned on the rubber seal (FIG. 3). The frame-like gap remaining between the work-top 1 and the cooktop panel 11 is jointed by a silicone seal 27, whereby the surface-flush installation of the cooktop 9 in the work-top cutout 3 is complete.

I claim:

1. In a work-top having a top side and a cutout with a border region, an installation strip for the surface-flush installation of a panel of a cooktop, the installation strip comprising:

a supporting section for supporting the cooktop; and at least one suspension section for suspendedly positioning said supporting section relative to a top side of a work-top in a border region of a work-top cutout, said at least one suspension section being spaced apart from said supporting section and connected to said supporting section, said suspension section removably connected to said supporting section at a predetermined breaking point.

2. The installation strip according to claim 1, wherein said at least one suspension section is vertically spaced apart from said supporting section.

3. The installation strip according to claim 1, wherein said supporting section supports a cooktop panel of the cooktop.

4. The installation strip according to claim 1, wherein said suspension section is connected to said supporting section at a bending point.

5. The installation strip according to claim 1, wherein the work-top cutout has a longitudinal side and said supporting section and said at least one suspension section together extend essentially over the entire length of the longitudinal side.

6. The installation strip according to claim 1, wherein the work-top cutout has an inner side, and said supporting section is plate-shaped and extends horizontally from the inner side of the work-top cutout to beneath a cooktop panel.

7. The installation strip according to claim 1, wherein said supporting section is a plurality of supporting sections, and said plurality of supporting sections form an installation frame.

8. A cooktop for installation in a work-top having a top side and a cutout with a border region, comprising:

a cooktop panel; and at least one installation strip for the surface-flush installation of said cooktop panel in a work-top, said at least one installation strip having:

a supporting section for supporting a cooktop; and at least one suspension section for suspendedly positioning said at least one installation strip relative to a top side of the work-top in a border region of a work-top cutout, said at least one suspension section being spaced apart from said supporting section and connected to said supporting section, said suspension section removably connected to said supporting section at a predetermined breaking.

* * * * *